US008156659B2

(12) United States Patent
Jung et al.

(10) Patent No.: US 8,156,659 B2
(45) Date of Patent: Apr. 17, 2012

(54) FILTER CLEANING APPARATUS AND DUCTLESS DRYER IMPLEMENTING THE SAME

(75) Inventors: Han-Yong Jung, Gyeongsangnam-Do (KR); Seung-Phyo Ahn, Gyeongsangnam-Do (KR); Sang-Ik Lee, Gyeongsangnam-Do (KR); Jea-Hyuk Wee, Gyeongsanguam-Do (KR); Yang-Ho Kim, Gyeongsangnam-Do (KR); Yoon-Seob Eom, Gyeongsangnam-Do (KR); Byeong-Jo Ryoo, Gyeongsangnam-Do (KR); Sung-Ho Song, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 1101 days.

(21) Appl. No.: 12/029,512

(22) Filed: Feb. 12, 2008

(65) Prior Publication Data

US 2008/0196268 A1 Aug. 21, 2008

(30) Foreign Application Priority Data

Feb. 20, 2007 (KR) ..... 10-2007-0017169

(51) Int. Cl.
*F26B 11/05* (2006.01)

(52) U.S. Cl. ..... 34/79; 34/82; 34/85; 198/810.02; 435/239; 210/103; 210/107

(58) Field of Classification Search ..... 34/79, 82, 34/85, 90, 603, 210, 242, 218.6; 198/810.02; 435/239; 210/103, 107

See application file for complete search history.

(56) References Cited

U.S. PATENT DOCUMENTS

| | | | | |
|---|---|---|---|---|
| 2,925,664 | A * | 2/1960 | Cobb et al. | 34/79 |
| 4,237,907 | A * | 12/1980 | Pawelko et al. | 131/286 |
| 4,297,209 | A * | 10/1981 | DeVisser et al. | 210/107 |
| 4,314,409 | A * | 2/1982 | Cartier et al. | 34/82 |
| 4,462,170 | A * | 7/1984 | Burkall et al. | 34/82 |
| 4,470,904 | A * | 9/1984 | Gail et al. | 210/103 |
| 4,729,468 | A * | 3/1988 | Pinck | 198/810.02 |
| 5,054,346 | A * | 10/1991 | Heitmann | 83/100 |
| 5,701,684 | A * | 12/1997 | Johnson | 34/595 |
| 2008/0196268 | A1 * | 8/2008 | Jung et al. | 34/603 |
| 2011/0318814 | A1 * | 12/2011 | Kshirsagar et al. | 435/239 |

FOREIGN PATENT DOCUMENTS

| | | | |
|---|---|---|---|
| CN | 2448866 | | 9/2001 |
| CN | 1088480 | | 7/2002 |
| DE | 84 37 357 | U1 | 3/1985 |
| DE | 4206461 | A1 * | 8/1993 |
| DE | 199 52 751 | | 6/2001 |
| EP | 534085 | A2 * | 3/1993 |
| EP | 1 098 028 | | 5/2001 |

(Continued)

*Primary Examiner* — Stephen M. Gravini
(74) *Attorney, Agent, or Firm* — Ked & Associates, LLP

(57) ABSTRACT

Disclosed is a filter cleaning apparatus and a ductless dryer adopting the same, the dryer having a main body, a drum rotatably mounted at the main body, a hot air supplying unit supplying hot air into the drum, a heat exchanger condensing and removing moisture contained in air exhausted from the drum, a circulation duct conducing the air exhausted from the drum to the heat exchanger, a filter installed in the circulation duct and filtering foreign substances contained in the air discharged from the drum, and a filter cleaning apparatus removing the foreign substances caught by the filter, thereby enhancing a user's convenience and reducing indoor air contamination which may occur in the course of removing the foreign substances.

6 Claims, 7 Drawing Sheets

FOREIGN PATENT DOCUMENTS

| | | | | |
|---|---|---|---|---|
| FR | 2714300 | A1 | * | 6/1995 |
| JP | 53021869 | A | * | 2/1978 |
| JP | 55027085 | A | * | 2/1980 |
| JP | 2008-006045 | | | 1/2008 |
| JP | 2011080636 | A | * | 4/2011 |
| KR | 10-0651856 | | | 11/2006 |

* cited by examiner

FILTER CLEANING APPARATUS AND DUCTLESS DRYER IMPLEMENTING THE SAME

BACKGROUND OF THE INVENTION

1. Field of the Invention

The present invention relates to a filter cleaning apparatus and to a ductless dryer having the same, and more particularly to a filter cleaning apparatus and a ductless dryer having the same which can enhance a user's convenience by automatically or manually removing foreign substances (debris) such as lint or fluff that reduce drying performance by blocking a channel when caught by a filter.

2. Description of the Background Art

In general, a clothes dryer is a device that absorbs moisture from objects to be dried (load) by blowing hot air generated by a heater into a drum and thereby dries the load. Clothes dryers may be roughly categorized into an exhaust type clothes dryer and a condensation type clothes dryer, according to the method employed for handling the humid air occurring when absorbing the moisture and drying the load.

The exhaust clothes dryer employs a method for exhausting the humid air flowing from the drum to the outside of the dryer. However, it requires an exhaust duct for exhausting the moisture evaporated in the drum to the outside. In particular, when gas heating is employed, the exhaust duct needs to be installed being extended long enough to the outdoors, considering that carbon monoxide, etc. as a product of combustion are also exhausted.

Meanwhile, the condensation (ductless) type clothes dryer uses a recirculation method that removes moisture by condensing the moisture from the humid air flowing from the drum in a heat exchanger and then recirculates the moisture-removed dry air back into the drum. However, the drying air flow forms a closed loop, making it difficult to use gas as a heating source.

A ductless dryer overcomes the demerits of the exhaust type dryer and the condensation type dryer. That is, the ductless dryer can be maintained at a low cost by using gas as a heating source and does not require an additional exhaust duct to be extended to the outdoors.

Meanwhile, the above-mentioned ductless dryer includes a filter for removing foreign substances (debris) such as lint or fluff contained in the air coming out of the drum.

However, in a related art dryer employing such a filter, a user must remove the filter out of the dryer after a certain number of drying operations are performed, clean out the filter to remove the filtered foreign substances such as the lint or the like, and then re-install the cleaned-out filter.

Accordingly, the user experiences the inconvenience of having to clean out the filter whenever necessary. And, while the filter is being cleaned, foreign substances such as lint or dirt may escape therefrom, thereby causing indoor air contamination and adversely affecting the user's health.

SUMMARY OF THE INVENTION

Therefore, it is an object of the present invention to provide a filter cleaning apparatus and a ductless dryer implementing the same, by which is not necessary for a user to frequently remove (clean) foreign substances filtered by the filter.

It is another object of the present invention to provide a ductless dryer, which can prevent an occurrence of dust, etc. to be raised when foreign substances are removed (cleaned) from a filter thereof.

To achieve these and other advantages and in accordance with the purpose of the present invention, as embodied and broadly described herein, there is provided a filter cleaning apparatus, including: a foreign substance collecting unit for collecting foreign substances from a filter; and a foreign substance receiving unit for storing the foreign substances collected by the foreign substance collecting unit.

With such a structure, a user does not need to remove foreign substances such as lint and the like, which are filtered by a filter, directly from the filter.

The foreign substance collecting unit includes a scraper for moving along the filter and scraping foreign substances, and a driving unit for driving the scraper. While being moved by the driving unit, the scraper may automatically collect foreign substances filtered by the filter.

The scraper is moved by the driving unit and a first roller spaced from the driving unit. The scraper is disposed to be driven between the first roller directly driven by the driving unit and a second roller spaced from the first roller so that the scraper may linearly move for a certain length and fully clean an area of the filter.

The foreign substance receiving unit includes a reservoir for storing foreign substances collected by the foreign substance collecting unit, and a screen disposed in the reservoir and opened/closed in cooperation with the foreign substance collecting unit. That is, the screen is opened only when the foreign substances filtered by the filter are moved from the foreign substance collecting unit to the reservoir. Accordingly, indoor air contamination due to the leakage and dispersion of the foreign substances stored in the reservoir may be prevented.

The reservoir includes a lid for permitting the discharging of foreign substances contained in the reservoir, and an auxiliary filter for discharging air from inside the reservoir. Here, a pump is further provided for discharging the air inside the reservoir from the auxiliary filter to the outside and for compacting the foreign substances contained in the reservoir. When the volume of the foreign substances contained in the reservoir reaches above a receiving capacity of the reservoir, the foreign substances need to be removed (dumped). Here, the foreign substances may be removed by opening the lid.

In addition, more foreign substances may be contained by discharging the air existing among the foreign substances contained in the reservoir by the pump to the outside of the reservoir and then by compacting the foreign substances. The auxiliary filter may prevent the leakage and dispersion of the foreign substances to the outside of the reservoir.

The screen is opened/closed by the driving unit. That is, the screen disposed in the reservoir is driven by the driving unit of the foreign substance collecting unit. Accordingly, foreign substances in the reservoir are collected in cooperation with the foreign substance collecting unit, and an additional driving unit for opening/closing the screen is not required.

Meanwhile, the present invention also provides a ductless dryer, comprising: a main body; a drum rotatably mounted at the main body; a hot air supplying unit for supplying hot air into the drum; a heat exchanger for condensing and thereby removing moisture contained in air exhausted from the drum; a circulating duct for inducing the air exhausted from the drum to the heat exchanger; a filter installed in the circulating duct for filtering lint contained in the air discharged from the drum; and a filter cleaning apparatus for removing foreign substances caught by the filter.

Here, the filter cleaning apparatus includes a foreign substance collecting unit for collecting foreign substances caught by the filter from the filter and a foreign substance receiving unit for storing the foreign substances collected by the foreign substance collecting unit. As a result, by directly removing the foreign substances caught by the filter, a user may experience less inconvenience of cleaning the filter.

The filter is formed to be open to both sides with respect to one connected edge between the front and rear surfaces thereof. That is, the filter includes meshes respectively disposed on the front and rear surfaces thereof for filtering foreign substances and approximately two members being opened to both sides.

The filter cleaning apparatus includes a guide formed at the filter being opened to both sides and a slider for collecting foreign substances by moving along the guide as the filter is opened. Accordingly, the slider collects the foreign substances caught by the filter at a lower portion of the filter, and the user only has to remove the foreign substances collected at the lower portion of the filter thus to reduce inconveniences of cleaning the filter.

The filter cleaning apparatus further includes a link member of which one end is fixed to the slider and another end thereof is fixed to the filter facing the slider. That is, a user simply opens the filter to empty out the filter, without needing to perform a cleaning operation.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the preferred embodiments of the present invention, examples of which are illustrated in the accompanying drawings.

Figure 1:
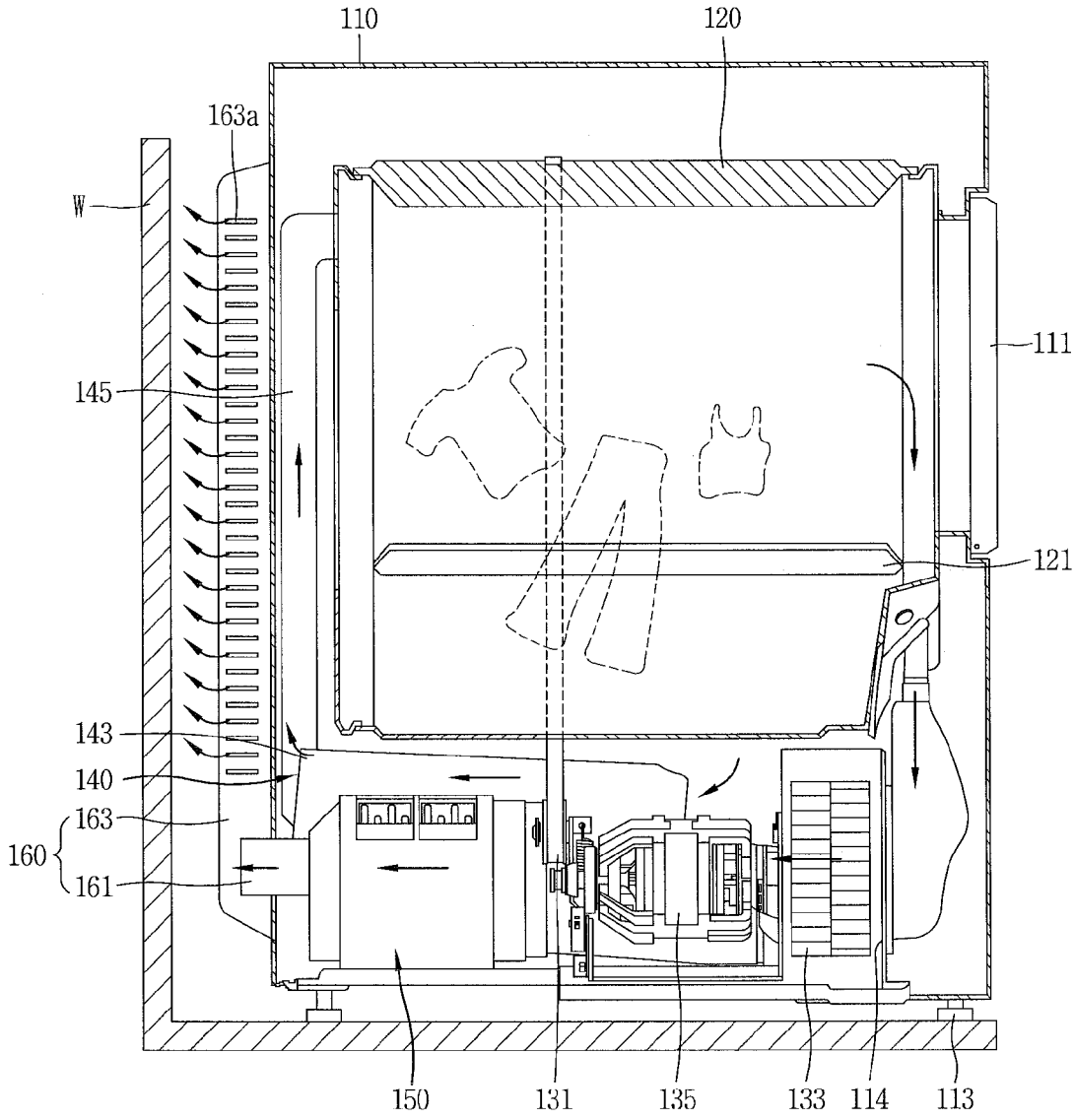
FIG. 1 is a left side cross-sectional view of a ductless dryer according to the present invention.
Figure 2:
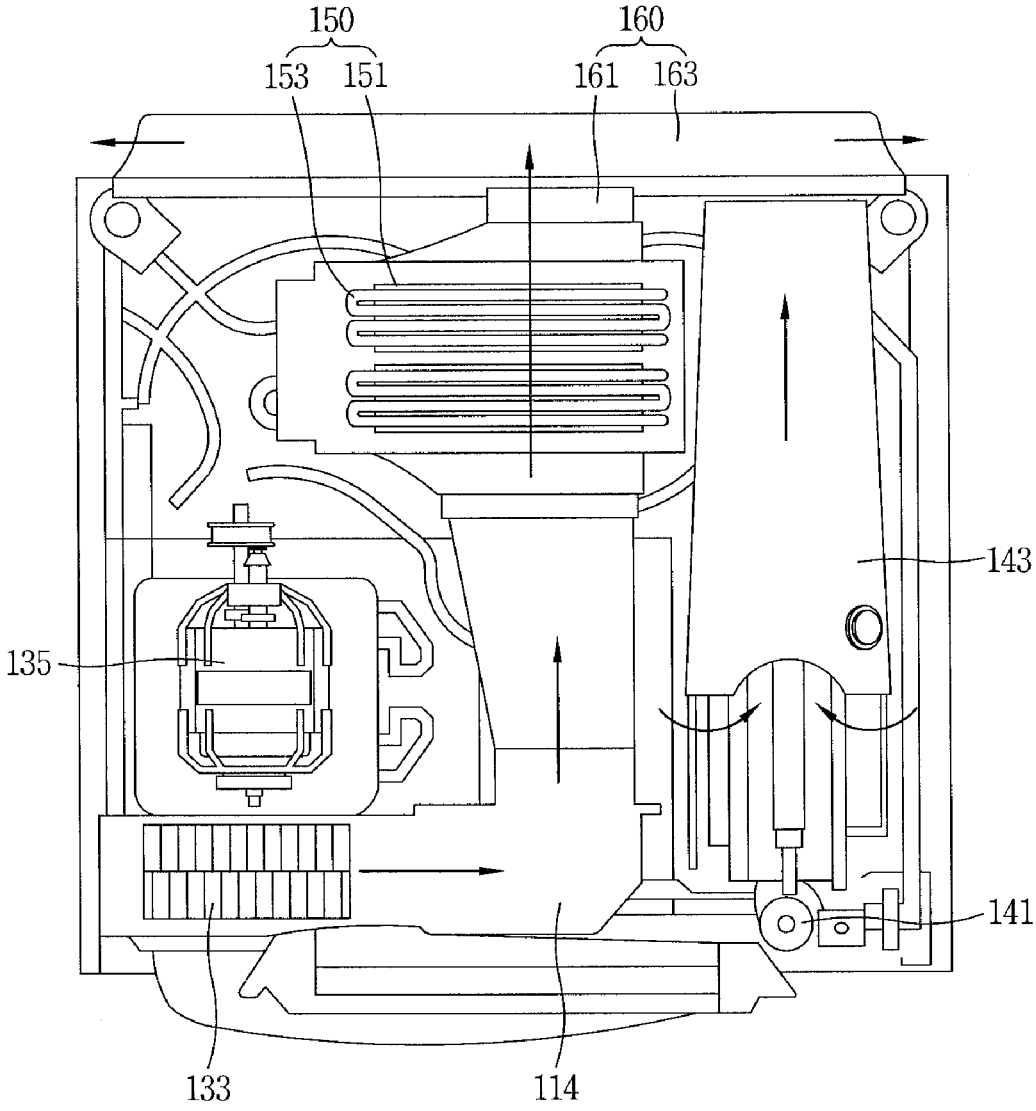
FIG. 2 is a top cross-sectional view of the ductless dryer in FIG. 1.

FIG. 1 is a side cross-sectional view of a ductless dryer according to the present invention. FIG. 2 is a top cross-sectional view of the ductless dryer in FIG. 1, and FIG. 3 is a front perspective phantom view showing internal components of the ductless dryer in FIG. 1.

Figure 3:
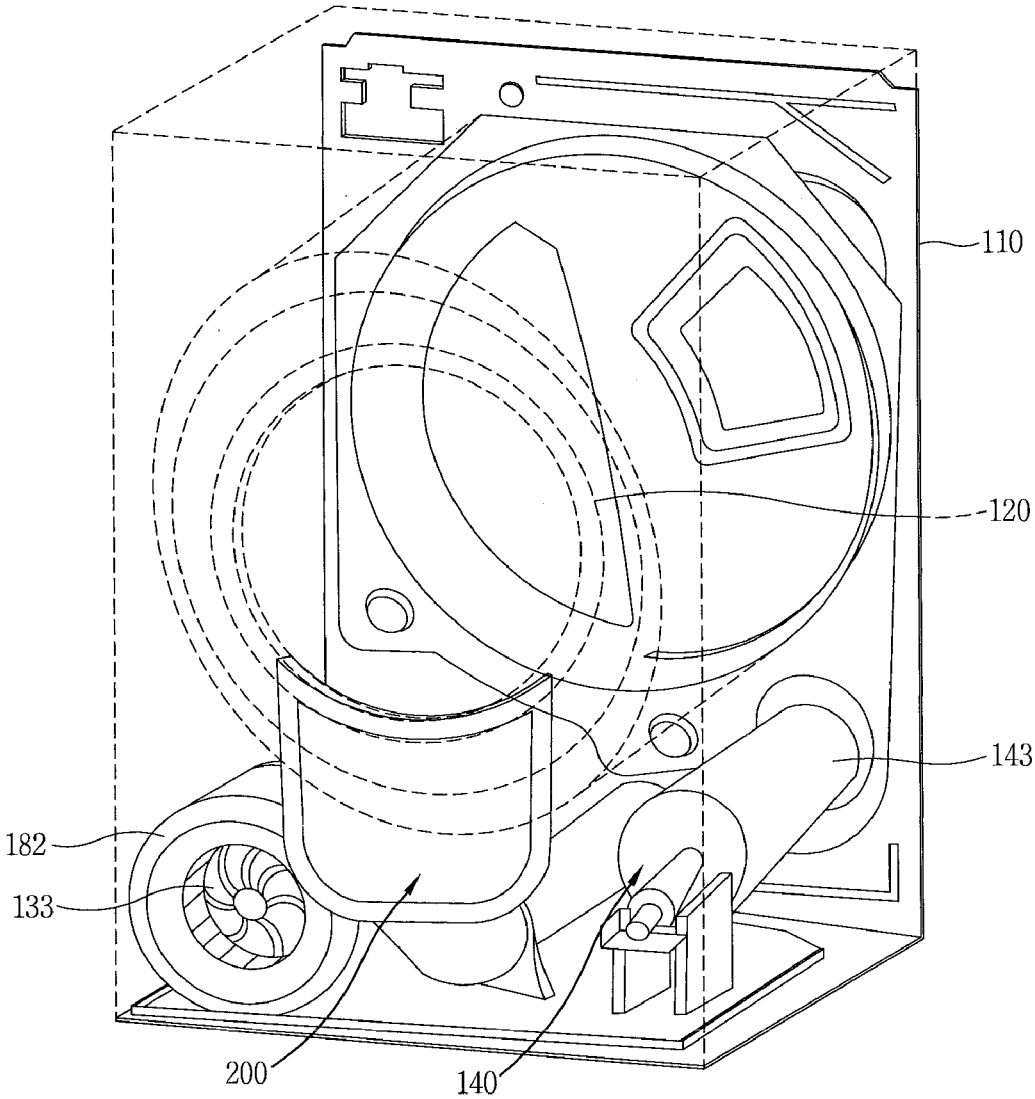
FIG. 3 is a front perspective phantom view showing internal components of the ductless dryer in FIG. 1.

Referring to FIGS. 1 through 3, the ductless dryer according to one embodiment of the present invention includes a main body 110; a drum 120 rotatably mounted at the main body 110; a hot air supplying unit 140 supplying hot air into the drum 120; a heat exchanger 150 condensing and removing moisture contained in their exhausted from the drum 120; a circulation duct 180 conducting the air exhausted from the drum 120 to the heat exchanger 150; a filter 200 installed in the circulation duct 180 and filtering foreign substances contained in the air coming out of the drum 120; and a sealing unit S preventing the leakage of foreign substances through a gap of an installation portion where the filter 200 is installed.

A door 111 is mounted on a front surface of the main body 110 to enable loading of clothes into the drum 120. A foot 113 is disposed at a lower portion of the main body 110 to support the main body 110. A belt 131 for rotating the drum 120 and a driving unit 135 for supplying a driving force to the belt 131 are mounted inside the main body 110. A pulley 137 for winding the belt 131 is disposed on a shaft of the driving unit 135.

The drum 120 is a container having an inner space into which clothes, etc., as objects to be dried, can be loaded. A plurality of lifters 121 are installed inside the drum 120 so as to lift the clothes.

The hot air supplying unit 140 includes a valve 141 controlling the supplying of gas, a gas burner 143 mixing the gas supplied from the valve 141 with an air supplied from the outside, igniting it, and then generating hot air, and a hot air supplying duct 145 communicating the gas burner 143 with the drum 120 so as to supply the generated hot air to the drum 120. In order to indirectly determine the amount of carbon monoxide (CO) emissions through a numerical value of a flame current by detecting the flame current, a flame rod extending to an edge of a flame may be installed in the hot air supplying unit 140.

Preferably, the valve 141 is implemented as a solenoid valve so as to sensitively adjust the amount of gas supplied.

While being supplied by the valve 141, the gas burner 143 heats the air with the heat generated when the gas supplied from the valve 141 is mixed with the outside air and then burned. The hot air generated by being thusly heated is provided to the drum 120 through the hot air supplying duct 145.

The heat exchanger 150 includes fins 151 and a tube 153. The heat exchanger 150 condenses moisture from the air of high temperature and humidity coming out of the drum 120 through a heat exchange method of air to water by using water of low temperature, to thereby dry the air. An inlet of the heat exchanger 150 is connected to the drum 120 by a circulation duct (not shown), and an outlet thereof is connected to an exhaust duct 161.

The fins 151 are thin metallic plates having excellent thermal conductivity and are laminated as a plurality of thin vertical metallic plates having a minute distance therebetween so as to contact with the air of high temperature and humidity as it passes through.

Water of low temperature (22° C.) is circulated through the tube 153. The tube 153 penetrates the fins 151 in a serpentine manner. Both ends of the tube 153 are connected to a water lines (not shown) for supplying and draining water of low temperature. A water container (not shown) for collecting condensed water, which is generated during the condensation process and dropped, is installed at a lower portion of the heat exchanger 150.

A filter cleaning apparatus is disposed at a side surface of the filter 200.

Figure 4:
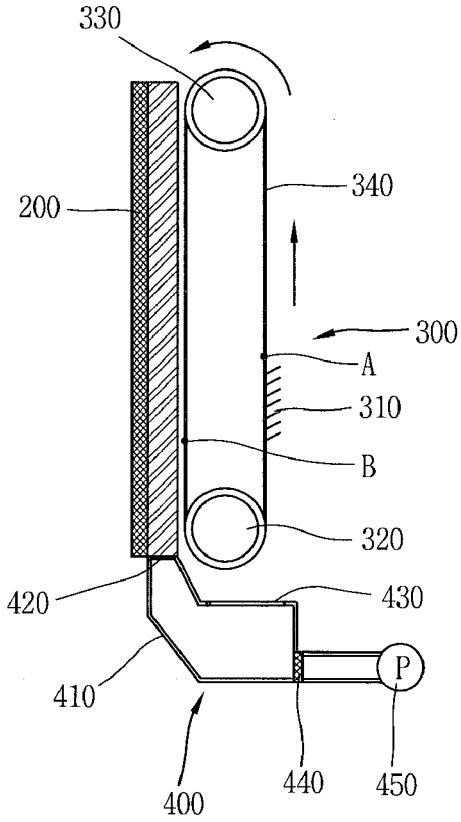
FIG. 4 is a cross-sectional view showing one embodiment of a filter cleaning apparatus which is applied to the ductless dryer in FIG. 1.
Figure 5:
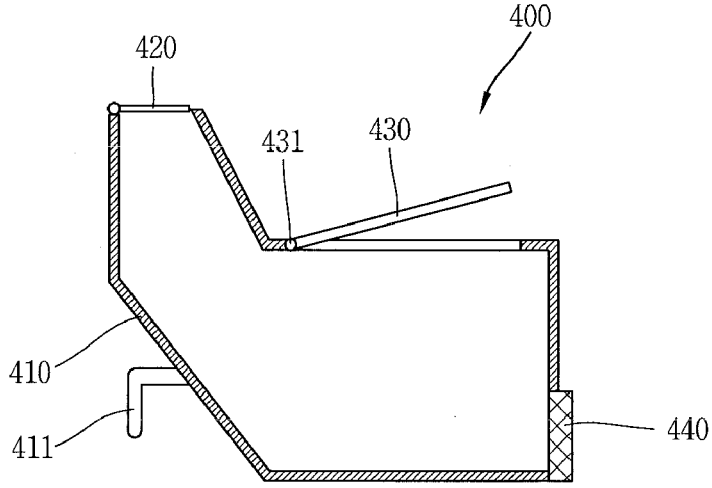
FIG. 5 is a cross-sectional view of a foreign substance receiving unit in the apparatus of FIG. 4.
Figure 6:
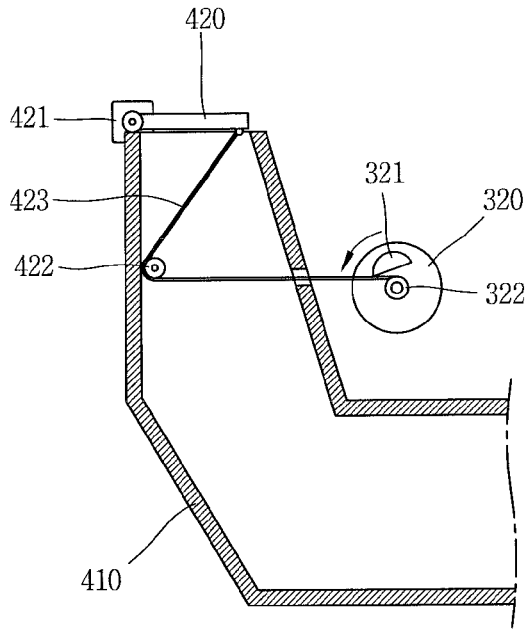
FIG. 6 is a cross-sectional view showing a switching structure of the foreign substance receiving unit in FIG. 5.

FIG. 4 is a cross-sectional view showing one embodiment of a filter cleaning apparatus which is applied to the ductless dryer in FIG. 1. FIG. 5 is a cross-sectional view of a foreign substance receiving unit in the apparatus of FIG. 4, and FIG. 6 is a cross-sectional view showing a switching structure of the foreign substance receiving unit in FIG. 5.

As shown in FIG. 4, one embodiment of the filter cleaning apparatus includes a foreign substance collecting unit 300 separating foreign substances from the filter 200 and a foreign substance receiving unit 400 storing the foreign substances collected by the foreign substance collecting unit 300. The foreign substance collecting unit 300 is disposed at a side surface of the filter 200 so as to cover the entire area of the filter 200.

The foreign substance collecting unit 300 includes a scraper 310 moving along the filter 200 and scraping foreign substances, and a driving unit 320 driving the scraper 310. That is, while being moved by the driving unit 320 from an upper portion of the filter 200 to a lower portion thereof, the scraper 310 scrapes foreign substances caught on the surface of the filter 200.

Here, the connection between the driving unit 320 and the scraper 310 may be variously configured. The scraper 310 may be configured to move by being directly connected to a rotation shaft (not shown) of the driving unit 320. In this case, it is more preferable to clean a specific area of the filter 200 on which foreign substances are intensively caught, rather than to clean the entire area of the filter 200.

To evenly clean the entire area of the filter 200, the scraper 310 needs to be configured to move from the upper portion of the filter 200 to the lower portion thereof. For this, a driving unit 320 and a separate roller 330 spaced from the driving unit 320 with a certain gap therebetween are disposed, and the scraper 310 is disposed on a conveyor belt 340 installed on the driving unit 320 and the roller 330. The distance between the driving unit 320 and the roller 330 may be appropriately adjusted according to the size of the filter 200 to be cleaned. Here, another roller may be installed on an outer circumferential surface of the driving unit 320.

Further, scraper guides (not shown) may be respectively installed at each side with a gap therebetween corresponding to the width of the filter 200, a lead screw (not shown) may be disposed between the scraper guides, and the scraper 310 may be installed at the lead screw, thereby cleaning the filter 200. Here, the lead screw is rotated by the driving unit 320.

In addition, the scraper 310 may be disposed over the entire area of the belt 340. In this case, a screen 420 of the foreign substance receiving unit 400 is required to be open all the time.

Meanwhile, it is preferable to form a gap between the filter 200 and the scraper 310. The scraper 310 needs to be installed in consideration of the thickness of foreign substances to be caught on the surface of the filter 200. If not, it may be difficult to scrape foreign substances or may damage the filter 200.

The foreign substance receiving unit 400 is disposed at one end of the foreign substance collecting unit 300. Preferably, the foreign substance receiving unit 400 is disposed below the lower portion of the foreign substance collecting unit 300. A pump 450 for discharging air inside the foreign substance receiving unit 400 is installed at one side of the foreign substance receiving unit 400.

Referring to FIG. 5, the foreign substance receiving unit 400 includes a reservoir or catch bin 410 storing the foreign substances collected by the foreign substance collecting unit 300, and a screen 420 disposed in the reservoir 410 and opened/closed in cooperation with the foreign substance collecting unit 300.

That is, the foreign substance receiving unit 400 includes the reservoir 410 having a receiving space therein, a screen 420 for opening/closing an opening formed at an upper portion of the reservoir 410, and a lid 430. The screen 420 is used to put foreign substances scraped by the foreign substance collecting unit 300 into the reservoir 410. The lid 430 is used to discard the foreign substances in the reservoir 410. The lid 430 is opened/closed by a hinge 431 disposed in the reservoir 410.

A handle 411 is disposed on an outer surface of the reservoir 410 for the user's convenience. An auxiliary filter 440 discharging therethrough air present among the foreign substances in the reservoir 410 to the outside is formed at one side of the reservoir 410. The pump 450 exhausting the air is installed at one side of the auxiliary filter 440. A duct (not shown) may be disposed communicating the auxiliary filter 440 and the pump 450. If the air present among the foreign substances contained in the reservoir 410 is not exhausted to the outside, the capacity of the reservoir 410 for holding the collected foreign substances could be limited due to the volume of the collected foreign substances. Accordingly, a user may experience inconvenience due to frequently needing to empty the reservoir 410. Therefore, by discharging the air in the reservoir 410 to the outside using the pump 450, the volume of the foreign substances may be reduced. Also, the auxiliary filter 440 can prevent the foreign substances contained in the reservoir 410 from being discharged to the outside due to the suction power of the pump 450.

Further, an alarm unit (not shown) is configured to inform the user of the need to empty the reservoir 410 when a certain quantity of the foreign substances are contained in the reservoir 410. In implementing the alarm unit, it is effective to use a pressure sensor which senses the pressure or weight of the foreign substances compressed by the pump 450 and then informs the user about the pressure or weight of the foreign substances.

The screen 420 is opened/closed by interworking with the operation of the foreign substance collecting unit 300. Such a structure for opening/closing by being interworked is illustrated in FIG. 6.

Referring to FIG. 6, the screen 420 is opened/closed by a spring box 421 mounted in the reservoir 410 and connected to one end of the screen 420. That is, the spring box 421 includes a spring (not shown) that urges the screen 420 closed upon returning to its original position by elastic restoration force after the screen 420 is opened for putting foreign substances into the reservoir 410. The spring may be installed on a side wall of the reservoir 410 to which the screen 420 approaches as the screen 420 is opened, or may be installed inside the spring box 421. If the spring is installed on the side wall of the reservoir 410, it is effective to use a compression spring. If the spring is installed inside the spring box 421, it is effective to use a tension spring.

An opening/closing wire or cable 423 is connected to the opening edge of the screen 420, and to the driving unit 320 of the foreign substance collecting unit 300 through a wire support 422 mounted in the reservoir 410. Preferably, the opening/closing wire 423 is connected to the driving unit 320 through a passage penetrating the side of the reservoir 410, and is connected to a shaft 322 of the driving unit 320.

A semi-circular protrusion 321 is disposed on one side of the shaft 322 of the driving unit 320. The protrusion 321 serves to wind up the opening/closing wire 423 as the driving unit 320 is rotated. When the screen 420 is in its closed position, the protrusion 321 is disposed to be at one side of the opening/closing wire 423 for connecting the wire support 422 and the shaft 322 of the driving unit 320.

Here, it is preferable to configure the protrusion 321 not to wind the opening/closing wire 423 when the driving unit 320 moves the scraper 310, and to configure the protrusion 321 to wind the wire 423 when the scraper 310 is to scrape all foreign substances caught by the filter 200 and put them into the reservoir 410. For this, a screw thread (not shown) may be formed such that the protrusion 321 approaches to the wire 423 as the driving unit 320 is rotated. Or, a separate controller (not shown) and an auxiliary driving unit (not shown) may be installed such that, when the scraper 310 approaches to the screen 420 of the reservoir 410, the controller operates the auxiliary driving unit and makes the protrusion 321 connected to the auxiliary driving unit to move toward the wire 423.

The embodiment of a filter cleaning apparatus which is applied to the ductless dryer as above-mentioned is operated as follows:

If foreign substances are caught by the filter 200 during drying or cooling operation of the ductless dryer, the driving unit 320 of the foreign substance collecting unit 300 operates. The scraper 310 scrapes the foreign substances caught by the filter 200 while moving in the direction of the arrow shown in FIG. 4. During this process, when the position 'A' of the conveyor belt 340 at which the scraper 310 is disposed reaches to the position 'B', the screen 420 is opened as the protrusion 321 is winding the opening/closing wire 423, and then the scraped foreign substances are put into the reservoir 410.

Here, when the screen 420 is opened and the foreign substances are put into the reservoir 410, the pump 450 operates to strongly suck the foreign substances and exhaust the air. As the dryer is used, the reservoir 410 becomes fully filled with the collected foreign substances by repeatedly performing this operation, until the alarm unit (not shown) informs a user about this. Accordingly, the user grasps the handle 411, takes the foreign substance receiving unit 400 out of the ductless dryer and then opens the lid 430 to empty the reservoir.

Next, another embodiment of the filter cleaning apparatus will be described.

Figure 7:
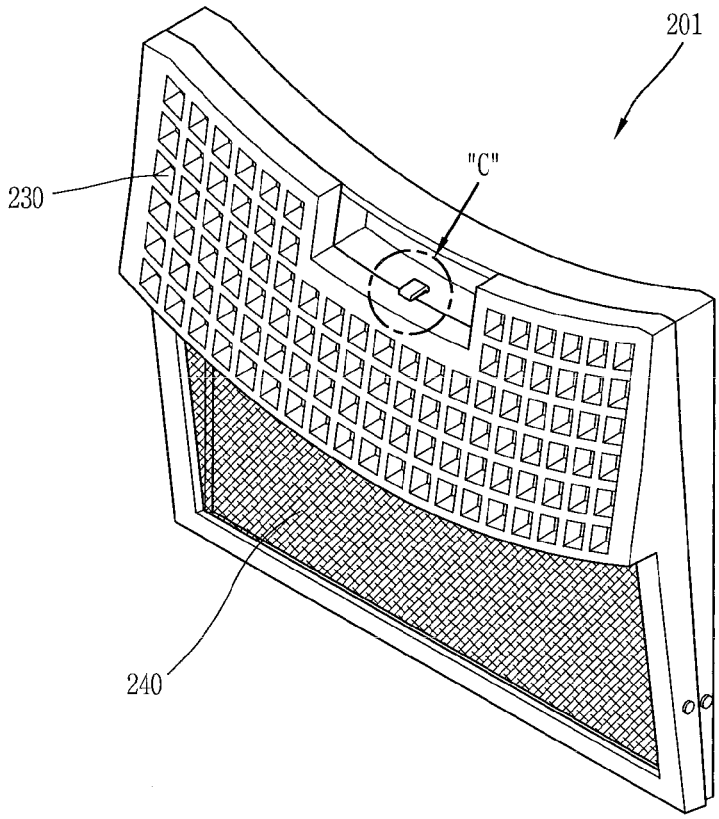
FIG. 7 is a perspective view showing another embodiment of a filter of the filter cleaning apparatus which is applied to the ductless dryer in FIG. 1.
Figure 8:
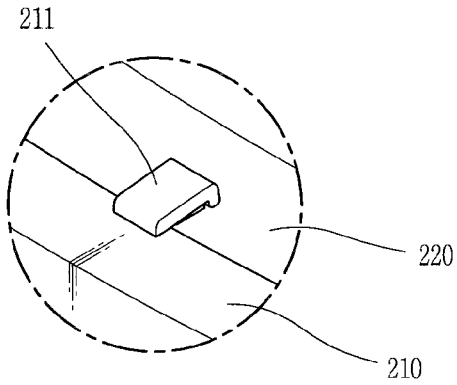
FIG. 8 is an enlarged detail view of a part "C" in FIG. 7.
Figure 9:
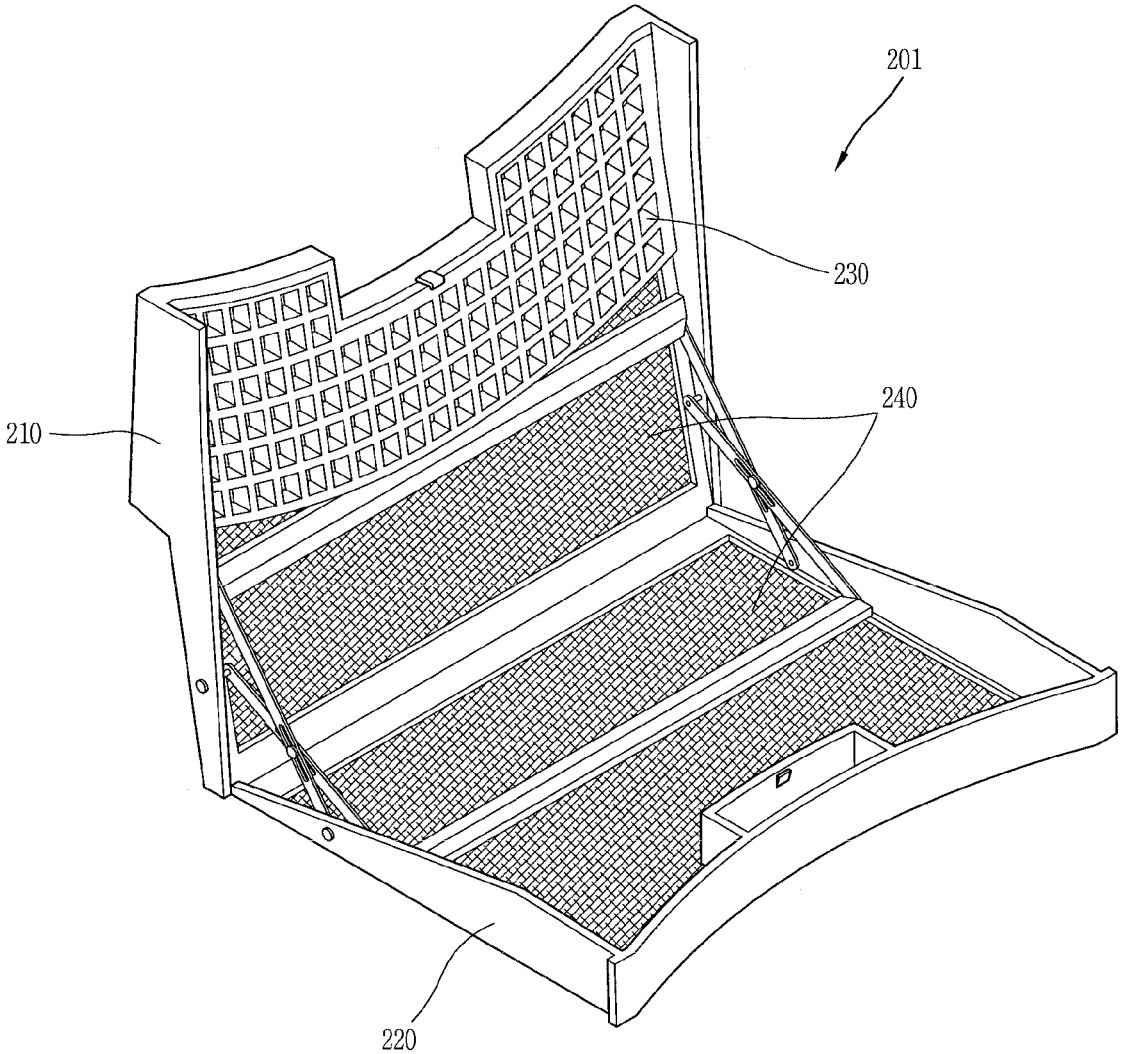
FIG. 9 is a side view showing the state when the filter in FIG. 7 is opened.
Figure 10:
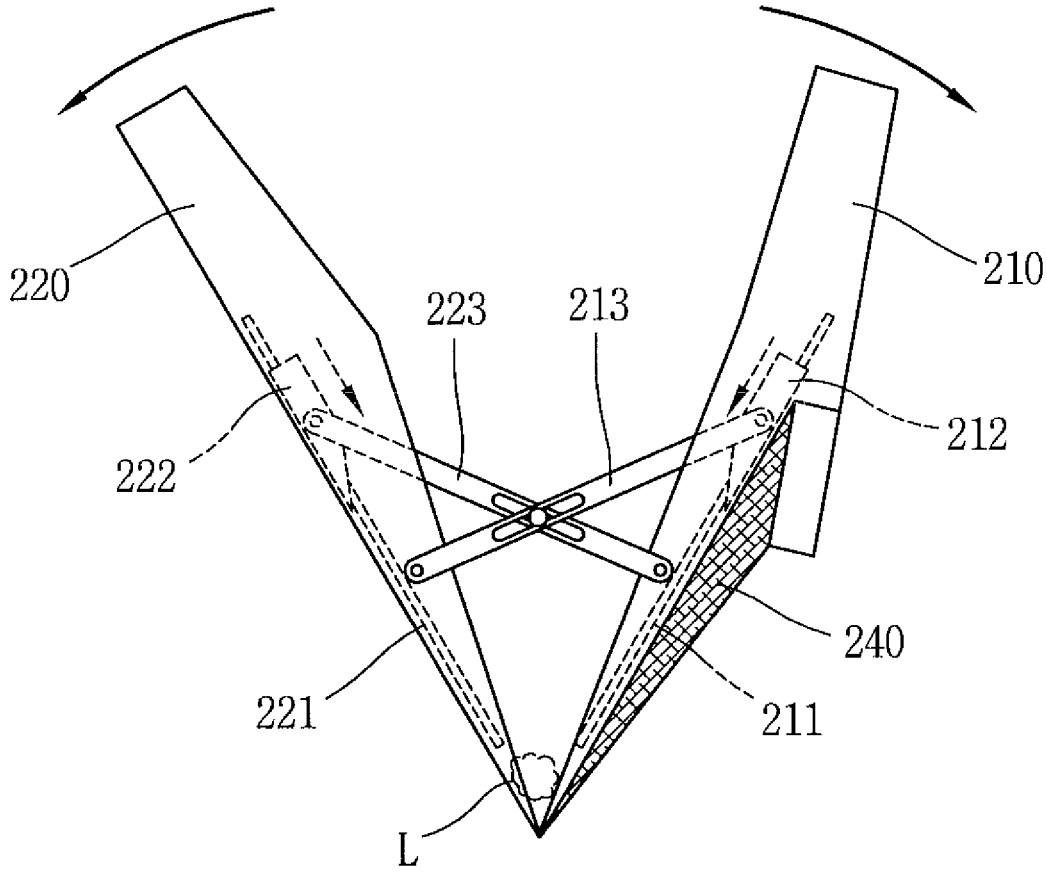
FIG. 10 is a side view showing the filter cleaning apparatus which is applied to the filter in FIG. 7.

FIG. 7 is a perspective view of a filter having another embodiment of a filter cleaning apparatus which is applied to the ductless dryer in FIG. 1. FIG. 8 is an enlarged detail view of a part "C" in FIG. 7. FIG. 9 is a perspective view showing a state that the filter in FIG. 7 is opened, and FIG. 10 is a side view showing the operation of the filter cleaning apparatus which is applied to the filter in FIG. 7.

Referring to FIGS. 7 through 9, another embodiment of the filter cleaning apparatus is applied to a filter 201 which has a different structure from the filter 200 described with reference to FIGS. 1 through 6.

The filter 201 is formed to be open to both sides and has one connected end or edge between its front and rear surfaces. As shown in FIG. 9, the filter 201 includes front and rear members 210, 220 each having a lower end or edge thereof connected to each other and having their other end opened. It may be referred to as a "V-filter" because it resembles a letter "V" when viewed from the side when the filter 201 is opened.

A foreign substance introducing unit 230 is disposed in the front member 210 of the filter 201 such that air containing foreign substances, etc. during a drying operation is introduced into the filter 201. A foreign substance filtering unit 240*a* for filtering the foreign substances is disposed below the foreign substance introducing unit 230. A further foreign substance filtering unit 240*b* is formed over almost the entire area of the rear member 220 of the filter 201.

It is effective to form the foreign substance filtering units 240*a*, 240*b* in a mesh form for filtering foreign substances and the like.

Meanwhile, the front member 210 and the rear member 220 are required to firmly connect to each other such that foreign substances collected between the foreign substance filtering units 240*a*, 240*b* of the front and rear members 210, 220 can be prevented from being leaked to the outside. As shown in FIG. 8, a hook or catch arrangement 211 is provided to connect the open ends of the two members 210, 220.

The filter cleaning apparatus mounted in the filter 201 will be described with reference to FIGS. 9 and 10. Referring to FIG. 10, the filter cleaning apparatus includes guides 211, 221 formed at the filter 201 being opened to both sides, and sliders 212, 222 for collecting foreign substances by moving along the guides 211, 221 as the filter 201 is opened.

The filter cleaning apparatus further includes link members 213, 223 having one end of which is respectively fixed to the sliders 212, 222 and the other ends thereof are respectively fixed to the front and rear members 210, 220 facing the sliders 212, 222.

The guides 211, 221 are respectively formed in the front member 210 and the rear member 220 of the filter 201. Preferably, the guides 211, 221 are disposed on both of the foreign substance filtering units 240*a* and 240*b* and have a round rod shape.

It is effective to form the sliders 212, 222 to have a certain width and a shape similar to a dustpan for a household. That is, when viewed from the side, the sliders 212, 222 have a wedge or pointed shape at the front. Both side ends of the sliders 212, 222 move along the guides 211, 221.

As shown in FIG. 10, as the front and the rear members 210, 220 of the filter 201 are opened in the directions of the arrows (solid line), the sliders 212, 222 move downwardly to the lower portion of the filter 201 in the directions of the arrows (dotted line) along the guides 211, 221. Such movement of the sliders 212, 222 can be implemented by the link members 213 connecting the slider 212 mounted on the front member 210 with the rear member 220 as well as the link members 223 connecting the slider 222 mounted on the rear member 220 with the front member 210.

Preferably, the link members 213, 223 are disposed at both ends of the sliders 212, 222. The link members 213, 223 are connected to each other. Various arrangements are possible for connecting the link members 213, 223 to each other. For instance, a link member 213 may dispose a protrusion (not shown) at a central portion thereof, and a link member 223 may dispose a slot (not shown) therein such that the protrusion may move along the slot.

The ends of the link members 213, 223 are connected to the sliders 212, 222 and the front and rear members 210, 220 by a suitable means such as pins.

The operation principle of the filter cleaning apparatus as shown in FIGS. 7 through 10 will be described in detail with reference to FIG. 10.

When a drying operation is performed in the ductless dryer, drying air containing foreign substances, etc. is introduced into the space formed between the front member 210 and the rear member 220 through the foreign substance introducing unit 230 of the filter 201. The introduced drying air is blown through the foreign substance filtering units 240*a*, 240*b* of both sides by the fan 133. During this process, the foreign substances, etc. contained in the drying air are caught by the mesh-type foreign substance filtering units 240*a*, 240*b* and collected.

When a user opens the front and rear members 210, 220 of the filter 201 in the directions of the arrows (solid line) so as to remove the collected foreign substances from the filter 201, the sliders 212, 222 are moved from upper portions to lower portions of the filter 201 in the directions of the arrows (dotted line) by the link members 213, 223 having their ends fixed to the front and rear members 210, 220 of the filter 201, thereby scraping down the foreign substances caught by the foreign substance filtering units 240*a*, 240*b*. Accordingly, the user may easily handle the collected foreign substances L, without requiring a separate cleaning tool or a cleaning operation.

As so far described, the present invention provides a filter cleaning apparatus which can automatically or manually remove foreign substances such as lint and the like collected in the filter, thereby enhancing a user's convenience and reducing indoor air contamination which may occur in the course of removing the foreign substances.

In addition, the present invention provides a filter cleaning apparatus and a ductless dryer adopting the same, which can prevent the deterioration of the drying performance and its reliability due to a filter becoming blocked by foreign substances, by automatically removing the foreign substances caught by the filter after a drying operation.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A filter cleaning apparatus, comprising:

a foreign substance collecting device that collects foreign substances caught by a filter;

a foreign substance receiving device that stores the foreign substances collected by the foreign substance collecting device, wherein the foreign substance collecting device comprises:

a scraper that moves along the filter and scrapes foreign substances;

a device that drives the scraper; and a roller rotated by the drive to make the scraper perform an orbiting motion.

2. The apparatus of claim 1, wherein the foreign substance receiving device comprises:

a reservoir that stores foreign substances collected by the foreign substance collecting device; and a screen disposed in the reservoir and opened and closed in cooperation with the foreign substance collecting device.

3. The apparatus of claim 2, wherein the reservoir comprises a lid that permits the removal and discharge of foreign substances contained in the reservoir and an auxiliary filter through which air is discharged from inside the reservoir.

4. The apparatus of claim 3, wherein the foreign substance receiving device further comprises:

a pump that discharges air from inside the reservoir and thereby compacts the foreign substances contained in the reservoir.

5. The apparatus of claim 2, wherein the screen is opened/closed by the device.

6. The apparatus of claim 5, wherein the screen is opened and closed by a wire connected to a winding protrusion formed at the device.

* * * * *